United States Patent [19]

Eheim et al.

[11] Patent Number: 4,541,385

[45] Date of Patent: Sep. 17, 1985

[54] FUEL INJECTION SYSTEM FOR SELF-IGNITING INTERNAL COMBUSTION ENGINES

[75] Inventors: Franz Eheim, Stuttgart; Gerald Höfer, Weissach-Flacht; Konrad Eckert, Stuttgart; Heinz Links, Baiersbronn, all of Fed. Rep. of Germany

[73] Assignee: Robert Bosch GmbH, Stuttgart, Fed. Rep. of Germany

[21] Appl. No.: 543,719

[22] Filed: Oct. 20, 1983

Related U.S. Application Data

[62] Division of Ser. No. 225,164, Jan. 15, 1981.

[30] Foreign Application Priority Data

Jan. 15, 1980 [DE] Fed. Rep. of Germany ..... 3001155

[51] Int. Cl.[4] ..... F02M 39/00

[52] U.S. Cl. ..... 123/446; 123/447; 123/450; 417/462

[58] Field of Search ..... 123/447, 450, 494, 357, 123/499, 458, 446, 496; 417/253, 252, 462

[56] References Cited

U.S. PATENT DOCUMENTS

| | | | |
|---|---|---|---|
| 3,516,395 | 6/1970 | Bassot | 123/446 |
| 3,592,177 | 7/1971 | Weitde | 123/446 |
| 4,171,099 | 10/1979 | Kopse | 123/446 |
| 4,280,464 | 7/1981 | Kanai | 123/447 |
| 4,282,843 | 8/1981 | Seilly | 417/253 |
| 4,377,139 | 3/1983 | Jarrett | 123/450 |

*Primary Examiner*—Carl Stuart Miller
*Attorney, Agent, or Firm*—Edwin E. Greigg

[57] ABSTRACT

A fuel injection system (FIG. 1) provided with pump-/nozzles is proposed, which has a central fuel metering device which functions with a deviation or metering piston and a distributor or multi-way valve as a metering control member.

3 Claims, 12 Drawing Figures

FUEL INJECTION SYSTEM FOR SELF-IGNITING INTERNAL COMBUSTION ENGINES

This application is a division, of application Ser. No. 225,164 still pending, filed Jan. 15, 1981.

BACKGROUND OF THE INVENTION

The invention is based on a fuel injection system for self-igniting internal combustion engines. In known fuel injection systems of this kind, the fuel metering is effected with the interposition of deviation pistons, which receive the fuel in the manner of a reservoir, and then yield it up again to the pump work chambers. The control of this yielding of the fuel is then effected in common with the intake stroke movement of the pump piston. The actual metering of the fuel is effected, however, upstream of the deviation piston. This known fuel injection system suffers from the disadvantages resulting from any throttle effects occurring in the line downstream of the metering apparatus and from the functioning of the deviation piston as well, with its hysteresis and restoring springs; these factors can change the already-metered quantity of fuel.

OBJECT AND SUMMARY OF THE INVENTION

The fuel injection system according to the invention has the advantage over the prior art that as the result of the combination of the piston and the control member (valve or distributor), there are no apparatuses at all disposed downstream of the metering unit which could affect the metered quantity. Furthermore, a plurality of important structural elements are disposed in a single component, saving both installation space and cost. Advantageous modifications of the invention are described in further detail below.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
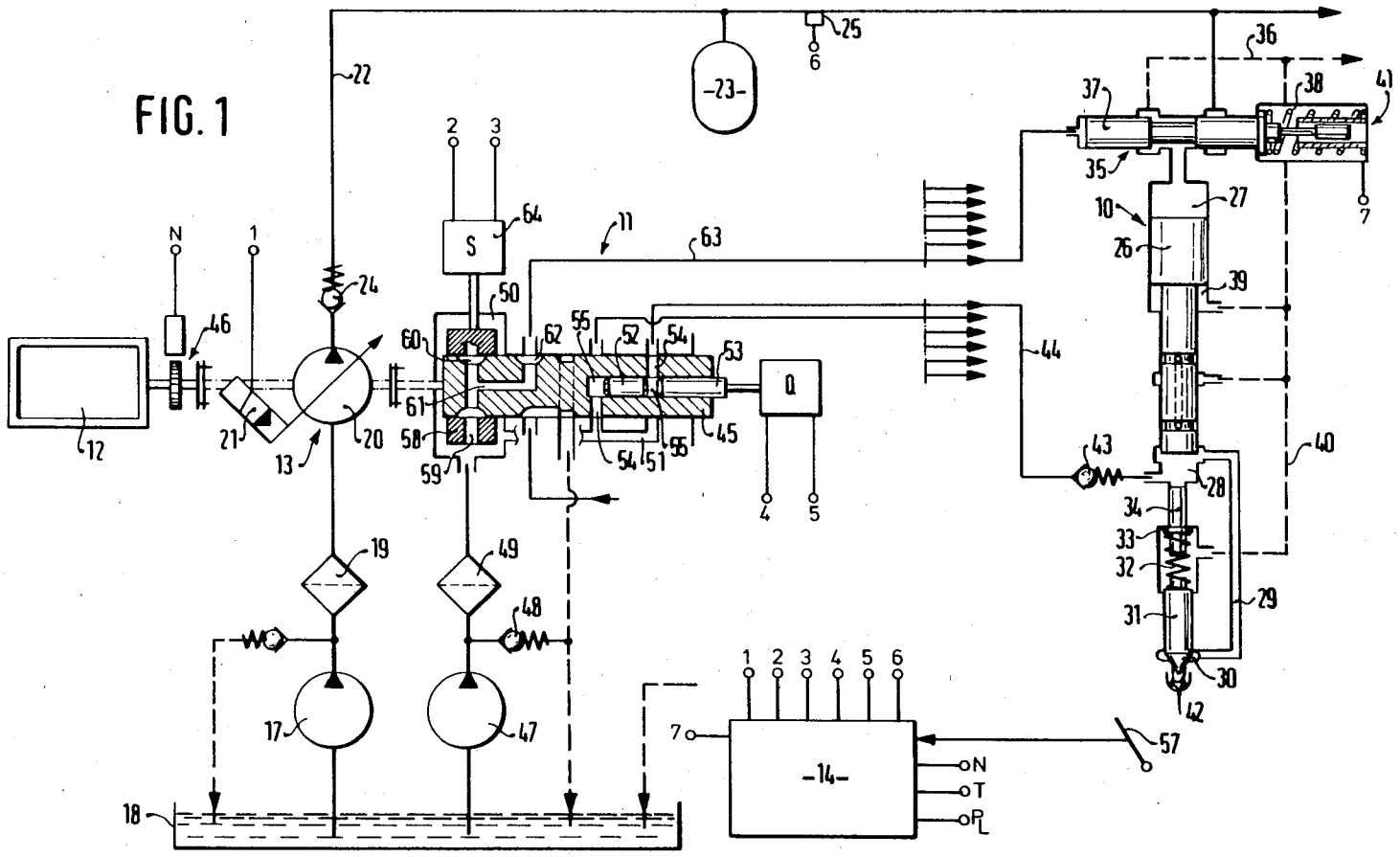
FIGS. 1–11 show the first exemplary embodiment with various distributor units having metering piston apparatuses.

In FIG. 1, a fuel injection system is shown for a six-cylinder engine. However, only one pump/nozzle 10 is shown, which is opened under the control of a metering and distributor unit 11 also controlling the other five pump/nozzles. While the metering and distributor unit 11 operates at an average fuel pressure, a pump system 13 also driven, like the metering and distributor unit 11, by the internal combustion engine 12 generates the high pressure for a servo fluid, which again is preferably fuel. The fuel injection system is regulated with the aid of an electronic control device 14, in which actual-value signals picked up at various points, as described below, are processed and appropriate set-point signals are fed via converters to the appropriate control elements of the injection system.

The high-pressure pump system 13 operates with two pumps disposed one after the other; the first is a prepump 17, which aspirates the fuel out of a container 18 and supplies it via a filter 19 to the second, which is a servopump 20 acting as the high-pressure pump. An electrical zerostroke control element or pressure maintenance valve serves to maintain sufficient pre-supply pressure. The pressure or the supply output of the servopump 20 can be varied via a magnetic control element 21. The magnetic control element 21, as a converter, receives the appropriate control signal from the electronic control device 14 via the terminal 1. A pressure line 22 leads from the servopump 20 to the individual pump/nozzles, which are all supplied with servo fluid, generally fuel, from this high-pressure line 22. A pressure reservoir 23 is connected to the pressure line 22 in order to maintain a substantially constant pressure at the nozzles. The pressure line 22 is coupled with the servopump 20 by way of a check valve 24. The pressure in the line 22 is measured by a transducer 25 and then fed to the electronic control device 14 via the connection terminals 6. Then, either the electronic control device 14 effects a correction of the supply pressure of the pump via the magnetic control element 21, if changes have been ascertained by the pressure transducer 25, or else this correction causes a change in the high pressure in accordance with other engine characteristics which have been fed into the electronic control device 14.

The pump/nozzles 10, only one of which is shown, operate with a servopiston 26. The servopiston 26 is embodied as a stepped piston (or it is made up of two pistons having different diameters), the larger face of which defines a servopressure chamber 27 and the smaller face of which defines the pump work chamber 28. A pressure line 29 leads from the pump work chamber 28 to the pressure chamber 30 of the nozzle. The nozzle operates with a nozzle needle 31, which is urged in the closing direction by a closing spring 32. The closing spring 32 is supported, on its side remote from the nozzle needle 31, on a shoulder 33 of a closing piston 34, which protrudes with its end face remote from the nozzle needle into the pump work chamber 28.

Communication between the servopressure line 22 and the servopressure chamber 27 is controlled by means of a slide valve 35. This slide valve 35 is actuated in synchronism with the cycles of the engine 12 by the metering and distributor unit 11, and it thus alternatively connects the servopressure chamber 27 with either the pressure line 22 or a relief line 36. The slide valve 35 operates with a control slide 37, which is hydraulically driven and displaceable counter to a restoring spring 38. The chamber 39 formed by the step of the servopiston 26 and the chambers receiving the springs 32 and 38 all communicate via a leakage line 40 with the relief line 36. The position and/or the distance travelled by the control slide 37 is measured by a travel transducer 41 and fed via the terminals 7 into the electronic control device 14.

The described pump/nozzle functions as follows:

The pump work chamber 28 is supplied by the metering and distributor unit 11 with a metered quantity of fuel via a metering line 44 and a check valve 43. The servopiston 26 is displaced during this operation into the servochamber 27, thus forcing fuel out via the slide valve 35 into the relief line 36. Then as soon as the control slide 37 has been displaced counter to the spring 38 by the metering and distributor unit 11, the servopressure line 22 is connected with the servopressure chamber 27; this occurs either after or shortly before the servopressure chamber 27 is separated from the relief line 36. As a result, the servopiston or pump piston 26 is displaced into the pump work chamber 28, thus forcing fuel via the pressure line 29 into the pressure chamber 30. As soon as a sufficiently high pressure has been attained, the valve needle 31 is displaced counter to the spring 32, so that the fuel reaches the combustion chamber of the engine via injection ports 42. After a predetermined supply stroke of the pump piston 26, its lower end face blocks the outflow to the pressure line 29, so that the fuel pressure in the chamber 28 increases further, until the closing piston 34 is first pressed against the spring 32 and then directly against the nozzle needle 31. In the meantime the supply to the pressure chamber 30 via the pressure line 29 has been interrupted, resulting in a rapid and good-quality closure of the injection nozzle. Then as soon as the control slide 37 slides back into its outset position in which it is shown in the drawing, which occurs under the control of the metering and distributor unit 11, fuel can again be metered into the pump work chamber 28, whereupon the pump piston 26 is again displaced accordingly. A new injection procedure can take place.

The metering and distributor unit 11 functions with a distributor 45, which is driven by the engine 12. The rpm of the distributor 45, and in the exemplary embodiment of the high-pressure pump 20 as well, is measured via an rpm transducer 26 and fed via the terminals N/N into the electronic control device 14. The distributor 45 has a twofold control function: first, it distributes a metered quantity of fuel to the various individual pump-/nozzles; and second, it determines the injection onset by actuating the control slides 37 (reversable valves). The distributor 45 receives fuel from a pump 47 which generates an average pressure. The supply pressure of this pump 47 is determined by a pressure control valve 48. A filter 49 is disposed between the pump 47 and the distributor unit 11. The fuel proceeds from the average-pressure pump 47 into a receptacle chamber 50 in the housing of the metering and distributor unit 11. From the receptacle chamber 50, the fuel then proceeds via a line 51 to the actual fuel metering apparatus. This fuel metering apparatus comprises a reciprocating metering piston 52, whose stroke is determined by a stop 53. The chambers 55 at either side of the metering piston 52 communicate via appropriate distributor bores 54 in the distributor 45 with the line 51 or the metering line 44 of the pump/nozzle in such a manner that one of the chambers 55 always communicates with the line 51 and the other of the chambers 55 communicates with the pump work chamber 28 and thus with the pump/nozzle. The metering piston 52 is displaced by the fuel flowing in via the line 51 and thus supplies fuel via the metering line 44 into the pump work chamber 28 until such time as the metering piston 52 strikes against the stop 53. The stop 53, in turn, is adjustable, so that the travel distance of which the metering piston 52 is capable determines the injection quantity. The initial points of the metering lines 44 and the point of discharge of the line 51 are distributed about the distributor 45 in such a fashion that the pump work chamber 28 of one pump nozzle after another is always being supplied with fuel, and this always takes place in alternation from one of the two metering chambers 55. The stop 53, in this exemplary embodiment, is adjusted by a servomotor Q, which receives its control signal via the terminal 4 from the electronic control device 14. At the same time, an actual-value transducer is available in the servomotor Q which furnishes the actual position of the stop 53 to the electronic control device 14 via the terminals 5. The fuel quantity to be injected is determined in the electronic control device 14 in accordance with various input variables. One of these input variables is the position of the gas pedal 57; another variable is the rpm, fed by the rpm transducer 46 via the terminal N. Other variables may be the temperature T or the air pressure $P_L$. In each case, there is a virtually optimal degree of freedom in the influence exerted upon the fuel injection quantity. Because the injection onset is determined in this case independently of the fuel metering, the distribution of the metered quantities to the individual nozzles can be made within fairly broad tolerances.

The second function of the distributor 45 is the control of the injection onset. To this end, an annular slide 58 is disposed about the distributor 45 in the vicinity of the receptacle chamber 50. This annular slide 58 has radial bores 59, which are opened during the rotation of the distributor 45 by longitudinal grooves 60 disposed in the jacket face of the distributor. A channel 61 disposed in the distributor 45 leads from the longitudinal grooves 60 to a longitudinal distributor groove 62 disposed in the jacket face of the distributor. This longitudinal distributor groove 62 opens up the discharge ends of control lines 63, which lead to the various pump/nozzles and then to the slide valves 35. The initial ends of the control lines 63 are correspondingly distributed about the circumference of the distributor 45, so that the slides 37 are actuatable one after another by means of the fuel flowing in from the receptacle chamber 50. The amount of overlap of the longitudinal groove 62 at the individual control lines 63 is relatively large, so that it is not necessary here to keep to precise tolerances. The opening up of the bores 59 by the longitudinal grooves 62, on the contrary, must be effected quite precisely, because this action determines the injection onset. Whenever the slide 37 of the pump/nozzle connects the pressure line 22 with the servopressure chamber 27, the injection begins. In order to be able to vary this injection onset, the annular slide 58 is rotatable on the distributor 45. As a result, the instant at which the longitudinal grooves 60 open the radial bores 59 is shifted relative to the rotary position of the drive shaft. The onset of injection—that is, the beginning of the actuation of the slide—is shifted accordingly. An injection time adjustment of this kind may be required for various reasons, in accordance with the rpm or in accordance with load, temperature, or other engine characteristics, for example. The rotation of the annular side 58 is effected with the aid of a servomotor 64. This servomotor 64, as a converter, receives its actuation signal from the electronic control device 14 via the terminals 2. The actual position of the rotary slide 37 is fed to the electronic control device 14 as a transducer value via the terminals 3. In order to correct any errors which might be produced by the hydraulic actuation, the transducer value of the servomotor 64 is compared with the transducer value of the transducer 41 from the slide valve 35. Here, as well, it is possible to attain an optimum result in terms of fine adjustment and in terms of influencing the fuel injection quantity, especially in consideration of various engine characteristics.

As a result of the selected combination of electronic transducers, electric converters and mechanical control elements, it is possible to influence the performance of injection via engine characteristics, without there being disadvantageous secondary influence exerted by various control units, such as the metering apparatus and the injection onset apparatus.

Figure 2:
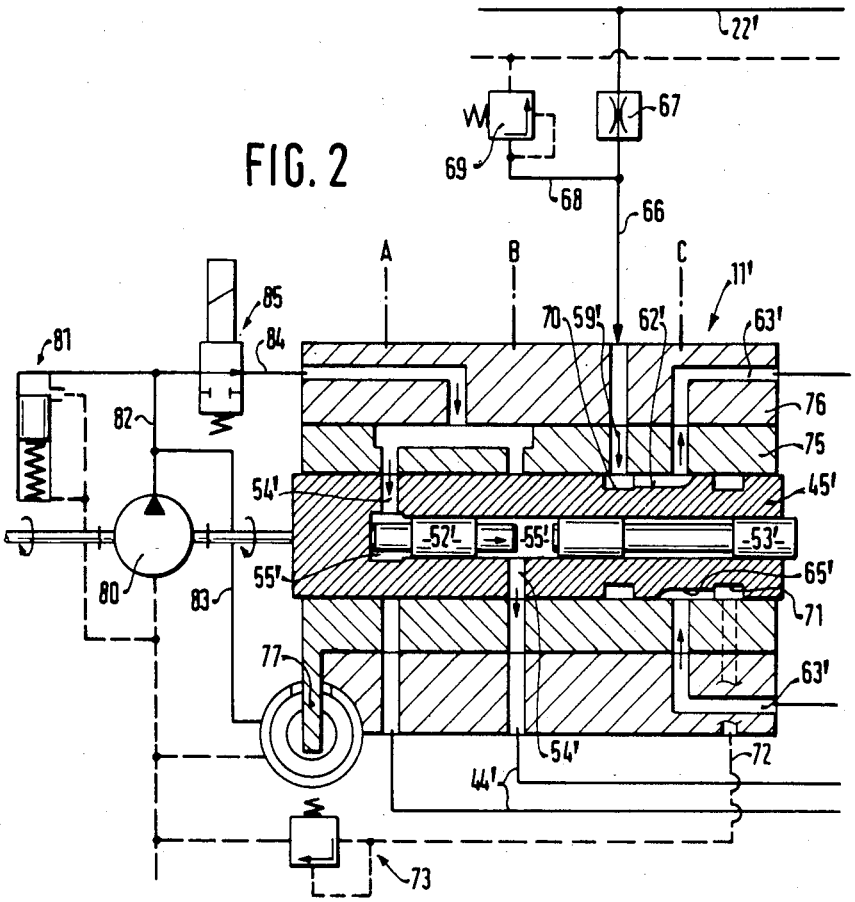

In FIG. 2, a metering and distributor unit is shown which functions in principle like that shown in FIG. 1. However, in contrast to the exemplary embodiment shown in FIG. 1, the fluid for controlling the injection onset is not drawn from the average-pressure pump for fuel; instead, it is taken from the high-pressure line 22' for the servofluid. The servofluid may, for example, be a more viscous oil acting as fuel, in order thereby to keep leakage amounts smaller; leakage is especially prevalent, of course, at high pressures. In order to arrive at an appropriate control pressure, a throttle 67 is inserted into the line 66 leading from the high-pressure line 22' to the distributor unit 11'. Downstream of this throttle 67, a control line 68 in which a pressure maintenance valve 69 is disposed branches off from the line 66. This manner of obtaining the control fluid for the injection onset is shown here purely by way of example. Naturally, in this exemplary embodiment shown in FIG. 2 as well, it is possible for fuel, or some other fluid supplied by an average-pressure pump, to be used as the control fluid.

The fuel then flows out of the line 66 via the radial bore 59' and reaches an annular groove 70 disposed in the jacket face of the distributor 45'. The longitudinal distributor groove 62' then branches off from this annular groove 70 and opens up the discharge ends, distributed about the circumference of the distributor 45', of the control lines 63' leading to the pump/nozzles in order to actuate the control slide disposed on the pump-/nozzle. The control lines 63' not connected to the distributor groove 62' may be relieved of pressure via longitudinal grooves 65', in order to enable a return stroke of the control slide of the pump/nozzle. The longitudinal groove 65' is likewise disposed in the jacket face of the distributor 45'. It discharges into an annular groove 71, which in turn communicates permanently with a leakage line 72. A pressure maintenance valve 73 is disposed in the leakage line 72 in order to maintain a minimum pressure in the control system for the injection onset, so that an overload of the control line is prevented from occurring.

Figure 5:
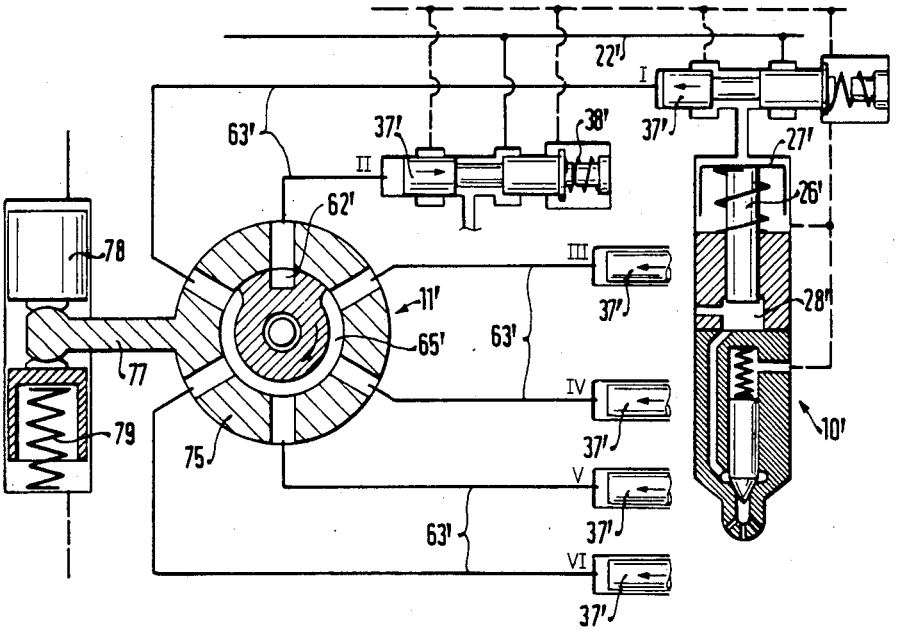

In FIG. 5, a section is shown taken through the distributor along line C of FIG. 2. The pump/nozzles opened by the distributor unit 11' are numbered I–VI. While the control slides 37' of nozzles I, II, IV, V and VI are shown as they execute their return stroke or have already assumed their outset position, the control slide 37' of the pump/nozzle II is moving counter to its restoring spring 38' and thus connects the pressure line 22' with the servopressure chamber 27' of the pump-/nozzle. The pump/nozzle 10' or I shown in this drawing is shown in the outset position of the pump piston 26'. In accordance with the control position the control position shown, the control line 63' of the pump/nozzle II communicates with the distributor groove 62'. The control lines 63' of pump/nozzles I and III, IV, V and VI, in contrast, communicate with the longitudinal relief groove 65'.

The distributor 45' is supported in a control sleeve 75, which is rotatably disposed in the housing 76 of the distributor unit 11'. When the control sleeve 75 is rotated, the instant at which the longitudinal distributor groove 62' opens the control line 63' is varied. Because it is intended to vary the injection onset primarily in accordance with rpm, a piston 78 engages one arm 77 of the control sleeve 75, the piston 78 being exposed on its side remote from the arm 77 to fluid whose pressure varies in accordance with the rpm. This variation of the instant of injection should be understood to depend on the rotary position of the engine shaft; that is, it depends on the position of the pistons of the engine. The higher the rpm, the earlier injection should occur, because there is correspondingly less time available for preparation of the fuel than at low rpm. For this reason, as the pressure of the fuel exerted on the piston 78 increases, the piston 78 is displaced downward in FIG. 5; this causes a corresponding variation in the injection onset toward "early", because the distributor groove 62' opens the control line 63' somewhat earlier. The displacement of the piston 78 is effected counter to the force of a restoring spring 79.

The rpm-dependent pressure of this injection onset adjustment apparatus is generated by a pump 80 (FIG. 2), which like the distributor 45' is driven by the engine. The supply pressure of the pump 80 is additionally controlled by a pressure control valve 81, so that it varies in proportion to the rpm. In addition to a line 83 leading to the injection adjustment apparatus, a line 84 branches off from the pressure line 82 of this pump 80 and leads to the metering unit of the pump/nozzles. This line 84 can be blocked by means of a magnetic valve 85. The metering unit housed in the distributor unit 11', in turn, functions with a metering piston 52' whose stroke is variable by means of a stop 53'. The radial bores 54' disposed in the distributor 45' cause the chambers at either side of the metering piston 52' to communicate alternatively with the line 84 or with one of the metering lines 44' leading to the pump/nozzles.

Figure 3:
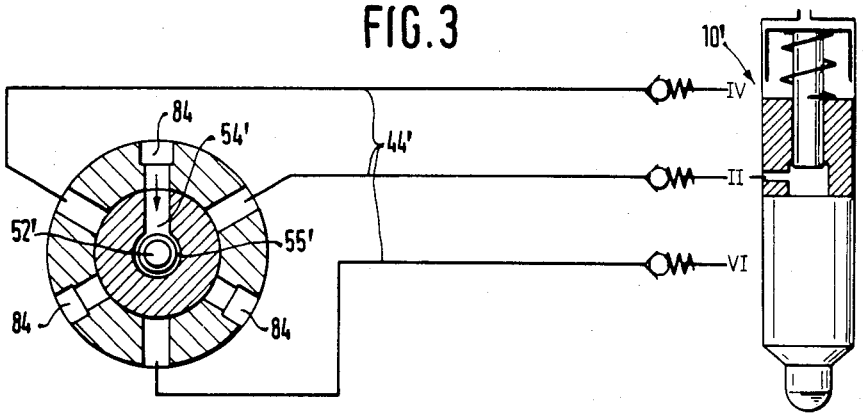

FIG. 3 shows a partial cross section through the distributor unit 11' along the line A of FIG. 2. In the position shown, the fuel can proceed directly from the pump 80 via the line 84 and the radial bore 54' into the chamber 55' ahead of the metering piston 52'. This metering piston 52' is thereby displaced accordingly. The pump/nozzles II, IV, and VI are supplied by the distributor in the plane indicated by the letter A. The metering lines 44', in this position, have just previously been blocked by the distributor 45'.

Figure 4:
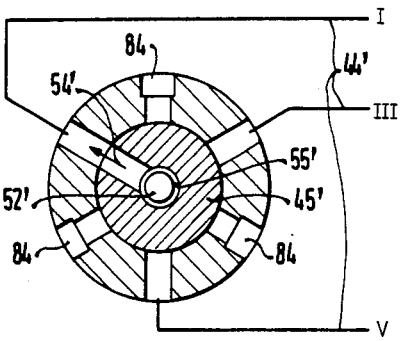

In FIG. 4, a section taken through the middle portion of the distributor unit 11' along the line B of FIG. 2 is shown. The positions in FIGS. 2, 3, 4 and 5 correspond with one another; that is, each of these figures shows one and the same position of the distributor 45'. In section B, the radial bore 54' has just previously opened up one of the control lines 44', specifically that control line 44' leading to the pump/nozzle I. The connections to the inflow line 84 or to the metering lines 44' of the pump/nozzles III and V are blocked. The metering piston 52' thus forces the fuel, the quantity of which has been determined by the possible stroke length of this piston 52', toward the pump/nozzle I.

Figure 6:
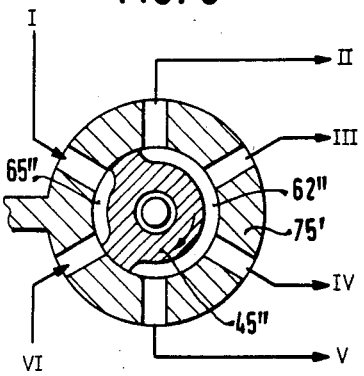

In FIG. 6, in turn, a section is shown which corresponds to that of FIG. 5. The distributor unit 11', however, is embodied to suit a different type of nozzle; that is, it is intended specifically for open nozzles. The open nozzle does not have a nozzle needle; instead, the fuel is stored up just behind the injection ports and injection then occurs as the fuel is pressed by the pump piston through the injection ports. However, to prevent the pump work chamber in an open nozzle of this kind from being filled with gases, the pump piston remains in its extended position until directly before the injection stroke. In FIG. 6, the longitudinal groove 62'', which is under fuel pressure, is made sufficiently wide so as to hold the control slides 37' of the pump/nozzles II, III, IV and V in the extended position and thus, correspondingly, to hold the pump pistons in their extended position. The control lines of the pump/nozzles I and VI, in contrast, communicate with the longitudinal groove 65'', which is relieved of pressure, so that the associated control slides 37' are in their outset position; as a result, the pump pistons 26' are likewise in their outset position. During this portion of time, the pump work chamber 28' is filled with fuel in the case of the pump/nozzle I by the distributor unit. Then as soon as the distributor 45'' has rotated further by about 60°, the pump/nozzle VI is in the injection status, while the pump/nozzle I in contrast is in a status immediately previous to injection. In the pump work chamber 28' of the pump/nozzle II at this time, in contrast, fuel is just now being metered.

In FIGS. 7–11, various apparatuses are shown with which the stop 53 of the metering piston 52 can be adjusted. In other words, these figures show the actual metering apparatus Q shown in FIG. 1.

Figure 7:
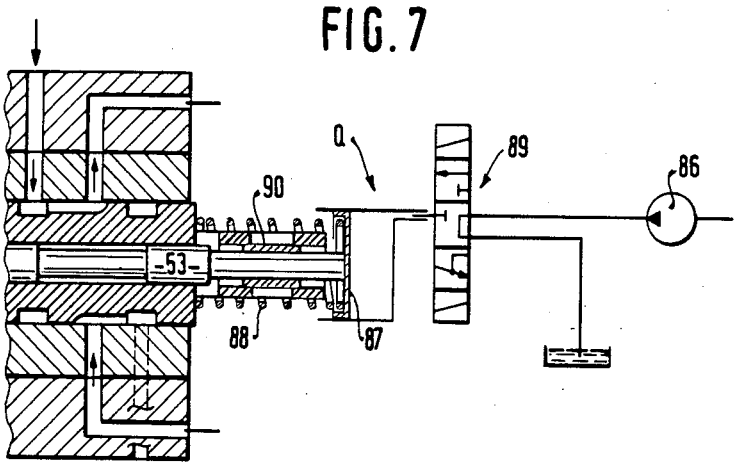

In the example shown in FIG. 7, the adjustment is effected hydraulically. The pressure fluid of a pump 86 serves to adjust a piston 87, which engages the stop 53. The adjustment occurs counter to the force of a restoring spring 88. Instead of the pump 86, a suitable fuel source of the fuel injection system may be used. The control of the fluid is effected via a magnetic valve 89, which is capable of assuming three different switching positions, that is, one neutral position and two different positions each effected by one of the two magnets. In the illustrated initially adjusted position, the adjusting piston 87 is blocked. As soon as the lower magnet is excited, the adjusting piston 87 is displaced by the spring 88 toward the right. As a result, the stroke of the metering piston 52 is lengthened and the injection quantity of the pump/nozzles increases. When the upper magnet of the magnetic valve 89 is excited, the adjusting piston 87 is displaced toward the left, counter to the force of the spring 88, and the injection quantity decreases. The position of the piston 87 at a particular time can be measured by a travel transducer 90, which plays a particularly important role whenever the system is being operated with an electronic control device, as shown in FIG. 1. An apparatus of this kind is particularly significant, given the increasing importance of digital electronic control devices.

Figure 8:
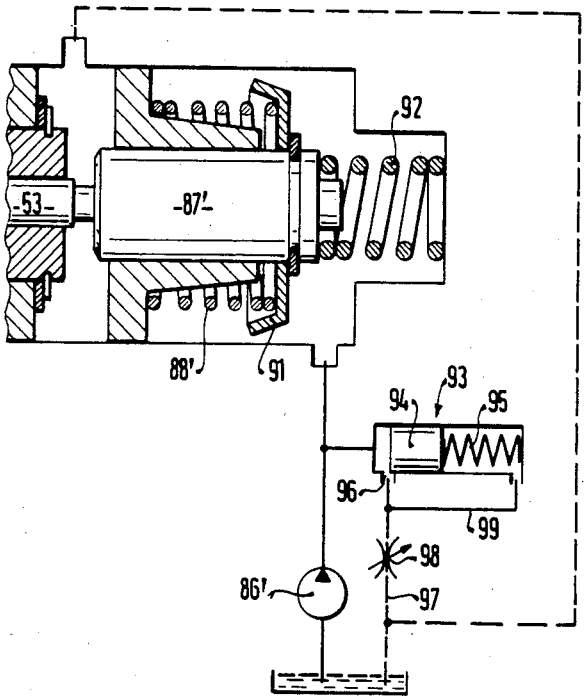

In FIG. 8, a fuel metering apparatus is shown which functions purely hydraulically. The pressure generated by the fluid source 86' is exerted upon an adjusting piston 87', which in turn directly engages the stop 53. The restoring spring 88', which is supported on a spring plate 91, acts counter to a compensating spring 92. The pressure of the adjusting fluid is determined by a pressure control valve 93, and as shown a piston 94 is displaced counter to the force of a restoring spring 95, thus opening a discharge opening 96 to a greater or lesser extent.

An adjustable throttle 98 is disposed in the outflow line 97 of the pressure control valve 93. Downstream of this throttle 98, a line 99 is provided which leads into the chamber receiving the spring 95. Depending upon how effective the action of the throttle 98 is, the pressure on the rear side of the control piston 94 increases, and thus the pressure exerted on the piston 87' of the quantity adjusting device also increases. The throttle 98 thus acts as a control variable for the fuel injection quantity. If the throttle is reduced in size, the piston 87' is displaced toward the left, and the fuel injection quantity is also reduced. If in contrast the throttle is increased in size, then the piston 87' is displaced toward the right and the injection quantity is increased.

Figure 9:
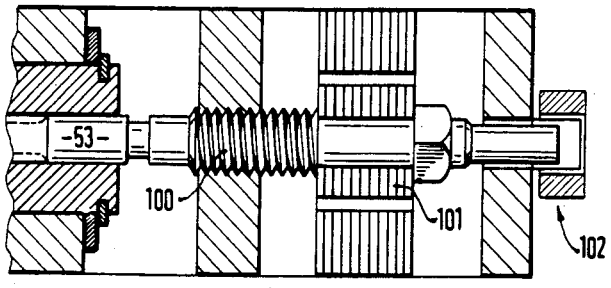

In the exemplary embodiment shown in FIG. 9, the stop 53 is adjusted via a threaded spindle 100, which can be turned by a servomotor 101. The stroke distance travelled by the spindle can be measured via a travel transducer 102. In the case of this apparatus as well, it is advantageous to have it cooperate with an electronic control device.

Figure 10:
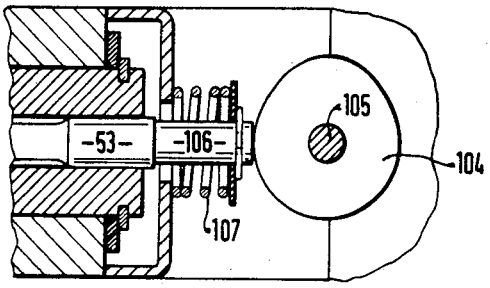

In the exemplary embodiment shown in FIG. 10, the adjustment of the stop is effected via a cam 104, which is actuatable via a shaft 105, which may be a rotary magnet, for example. The cam 104 then displaces an intermediate piston 106 counter to the force of a restoring spring 107.

Figure 11:
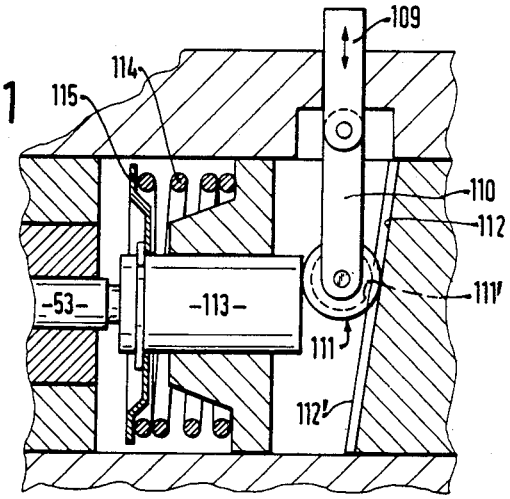

An apparatus with which the restoring forces can be absorbed in particularly favorable fashion is shown in FIG. 11. The stop 53 of the metering piston receives an impact, when the metering piston strikes it, which in relatively feeble adjusting apparatuses may cause incorrect regulation. The direction in which the impact is exerted is in the direction of an increasing injection quantity, so that the consequence of these impacts on the adjusting apparatus may be an undesirable increase in the fuel injection quantity, which accordingly may cause the engine to race.

In the illustrated exemplary embodiment, the control variable is supplied by way of a piston 109 which is displaceable transversely to the distributor axis and which in turn, via a lever 110, displaces a roller having wheels 111 and 111' of different diameters. This roller is supported on the end with the wheel 111' on an oblique plane 12 and on the other end acts with the wheel 111 upon an intermediate piston 113, which in turn engages the stop 53. The larger wheel 111 is kept free within a groove 112' of the plane 112. In order to assure a constant connection between the stop 53 and the intermediate piston 113, the intermediate piston 113 is urged by a spring 114, which is supported on a spring plate 115, in the direction of the stop 53. The forces exerted by the stop 53 on the piston 109 via the intermediate piston 113 and the roller 111 are thus reduced to a minimum. The transmission of these forces is naturally dependent on the inclination of the oblique plane 112. The flatter the obliquity is, the longer is the distance which the piston 109 must travel to effect a corresponding adjustment of the stop 53.

Figure 12:
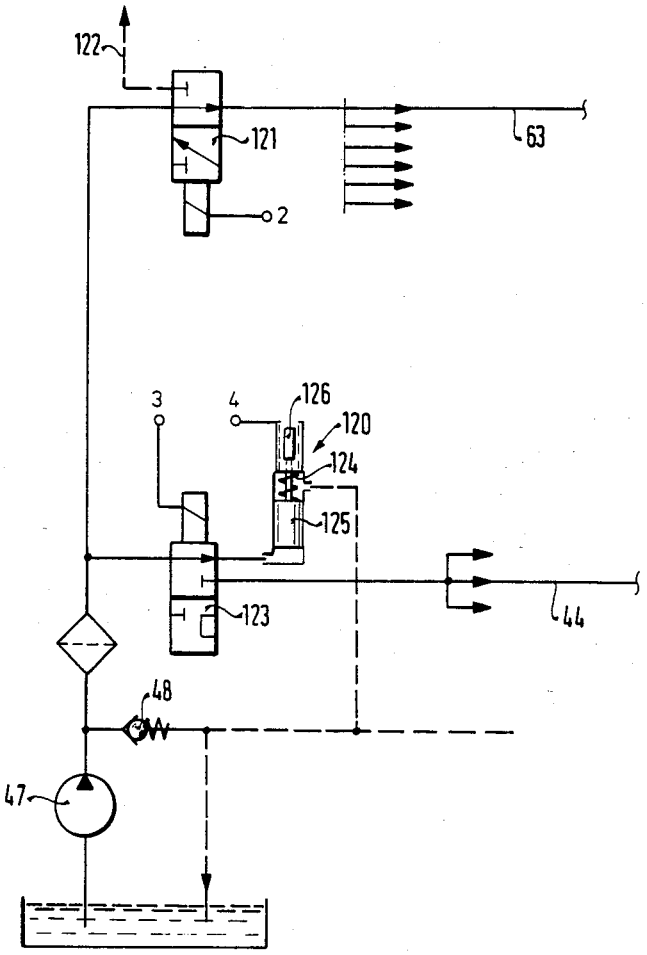
FIG. 12 shows the second exemplary embodiment.

In the second exemplary embodiment shown in FIG. 12, the metering and distributor unit is made up of two $\frac{2}{3}$-way magnetic valves and a deviation piston apparatus 120. The magnetic valve 121, one of which is associated with each pump/nozzle, serves to adjust the injection onset by actuating the slide valve 35 (FIG. 1). This is effected, depending upon the switching position of the $\frac{2}{3}$-way valve 121, either by connecting the pump 47 with the line 63 leading to the slide valve or by connecting the line 63 with a leakage channel 122. The fuel metering, in contrast, is effected via the magnetic valve 123, which in one switching position connects the pump 47 with the deviation piston apparatus 120 and in the other switching position connects the deviation piston apparatus 120 with the line 44 leading to the pump work chamber. The deviation piston apparatus 120 functions with a piston 125 which is subject to the force of a spring 124. The stroke of the piston 125 and thus the fuel quantity to be supplied into the pump work chamber by the spring 124 is measured by a stroke transducer 126. Because it is always only a portion of the pump piston wich by its working position enables the filling of the pump work chamber, a plurality of pump/nozzles may be supplied by means of one magnetic valve. In the example shown, there are three pump/nozzles. At all times, it is only that pump/nozzle which has completed or terminated an intake stroke which is supplied with fuel.

The transducer 126 and the magnetic valves 121 and 123 cooperate with the electronic control device.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system including a plurality of pump/nozzles for self-igniting internal combustion engines, each of said pump/nozzles including a pump piston and a pump work chamber below said pump piston, a deviation piston apparatus arranged to determine fuel quantity to be injected and further arranged to store fuel in said pump work chamber below said pump piston, said deviation piston apparatus including a variable stroke metering piston cooperating with a supply chamber below said stroke metering piston that is selectively connected via a first 3/2-way valve with a fuel source as well as with said pump chamber of one of said pump/nozzles, said metering piston being displaceable counter to a spring and said first 3/2-way valve in one control position is arranged to connect a metering supply chamber disposed on the side of the metering piston remote from said spring with the fuel source and in another control position is arranged to connect said metering supply chamber with said pump work chamber of said pump/nozzles wherein said spring acts as a drive means for said metering piston forcing a supply of fuel out of the metering supply chamber into said pump work chamber and a stroke of said metering piston is measured at least indirectly by means of a corresponding transducer and the measurement value is processed in an electronic control device in which characteristics such as those of the engine are processed, and by means of which said 3/2-way valve of the injection system is triggerable.

2. A fuel injection system as set forth in claim 1 which includes a slide valve which adjusts an injection onset of each of said plurality of pump/nozzles, and a second 3/2-way valve which connects a fuel supply from said fuel source to said slide valve in one position and to a leakage channel when in another position.

3. A fuel injection system as claimed in claim 1, wherein said plurality of pump/nozzles are supplied in succession with metered fuel during their intake stroke by means of said metering piston triggered by said first 3/2-way valve.

* * * * *